United States Patent [19]

White

[11] 4,310,993

[45] Jan. 19, 1982

[54] LOUVER ASSEMBLY

[75] Inventor: Thomas B. White, Turtle Creek Township, Warren County, Ohio

[73] Assignee: Louvers & Dampers, Inc., Cincinnati, Ohio

[21] Appl. No.: 110,172

[22] Filed: Jan. 7, 1980

[51] Int. Cl.[3] ..... E06B 7/08

[52] U.S. Cl. ..... 52/473; 98/121 R

[58] Field of Search ..... 52/473, 11; 98/121 R

[56] References Cited

U.S. PATENT DOCUMENTS

| | | | |
|---|---|---|---|
| 3,180,462 | 4/1965 | Grady | 52/473 X |
| 3,287,870 | 11/1966 | Johnson | 52/473 |
| 3,645,195 | 2/1972 | Koval | 98/121 R |
| 3,782,050 | 1/1974 | Dowdell et al. | 52/473 |
| 4,064,670 | 12/1977 | Lichtenwald | 52/473 |

*Primary Examiner*—James A. Leppink
*Assistant Examiner*—Carl D. Friedman
*Attorney, Agent, or Firm*—James W. Pearce; Roy F. Schaeperklaus

[57] ABSTRACT

A louver assembly that includes a rectangular frame. Vertically spaced louver blades span side members of the frame. A gutter member overlies the louver blades and underlies an upper member of the frame. The gutter member includes an outer wall panel having an upper edge terminating beneath an outer face of the upper member to define a transverse water inlet opening receiving rain water from the upper member and from a wall thereabove. Downspout means in one of the side frames receives water from the gutter member. Water from the louver blades is also received in one of the side frames but the water from the gutter member is isolated from the louver blades.

6 Claims, 7 Drawing Figures

LOUVER ASSEMBLY

This invention relates to an improved louver construction. More particularly, this invention relates to a louver construction which limits the amount of moisture carried therethrough.

Various types of louvers have been developed heretofore for use in buildings as air intakes and the like in which one side of the louver is exposed to the outside of the building. Examples of such louvers are shown in Johnson U.S. Pat. No. 3,287,870, Dowdahl 3,782,050 and Lichtenwald 4,064,670.

In such louvers, a major source of unwanted water is in flow down a wall of the building above the louver. Such flowing water can be picked up by air entering the louver to be carried into the building along with any other moisture carried by the entering air.

An object of this invention is to provide a louver construction which removes flowing water from a wall of a building above the louver.

A further object of this invention is to provide such a louver construction in which flowing water from above the louver is separated from water that is caught on louver blades for separate disposal.

A further object of this invention is to provide a louver construction in which inflowing air is caused to change direction as it passes between blades of the louver to cause impingement of droplets in the air onto the blades and to improve separation of the moisture.

Briefly, this invention provides a louver assembly which includes a plurality of vertically spaced louver blades. The louver blades are mounted in a frame, and the frame can be mounted in a wall of a building with an outer face of a header frame member substantially flush with the outer face of the wall. An opening in the header frame member receives water which flows down the outside face of the wall. A gutter member receives the flowing water from the opening and directs the flowing water to an edge frame. The water from the gutter is discharged downwardly through an upright enclosed discharge channel at the edge frame to below the blades. Water which accumulates on the blades is also directed to the edge frame and travels downwardly and is separated from the water from the cutter as it descends. The water is collected on a discharge platform below the blades and is discharged therefrom. Each louver blade slopes upwardly from an air entry edge at a moderate angle to the horizontal and then extends upwardly at a steeper angle to a discharge edge so that the air passing between the blades is caused to change direction, and droplets of moisture in the air are caused to impinge on the blades to be extracted from the entering air.

The above and other objects and features of the invention will be apparent to those skilled in the art to which this invention pertains from the following detailed description and the drawings, in which.

In the following detailed description and the drawings, like reference characters indicate like parts.

Figure 2:
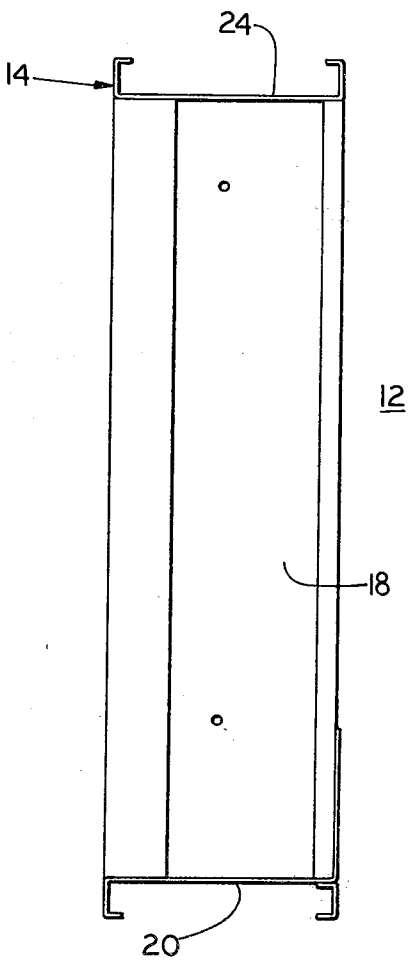
FIG. 2 is a view in side elevation of the louver assembly removed from the wall.
Figure 1:
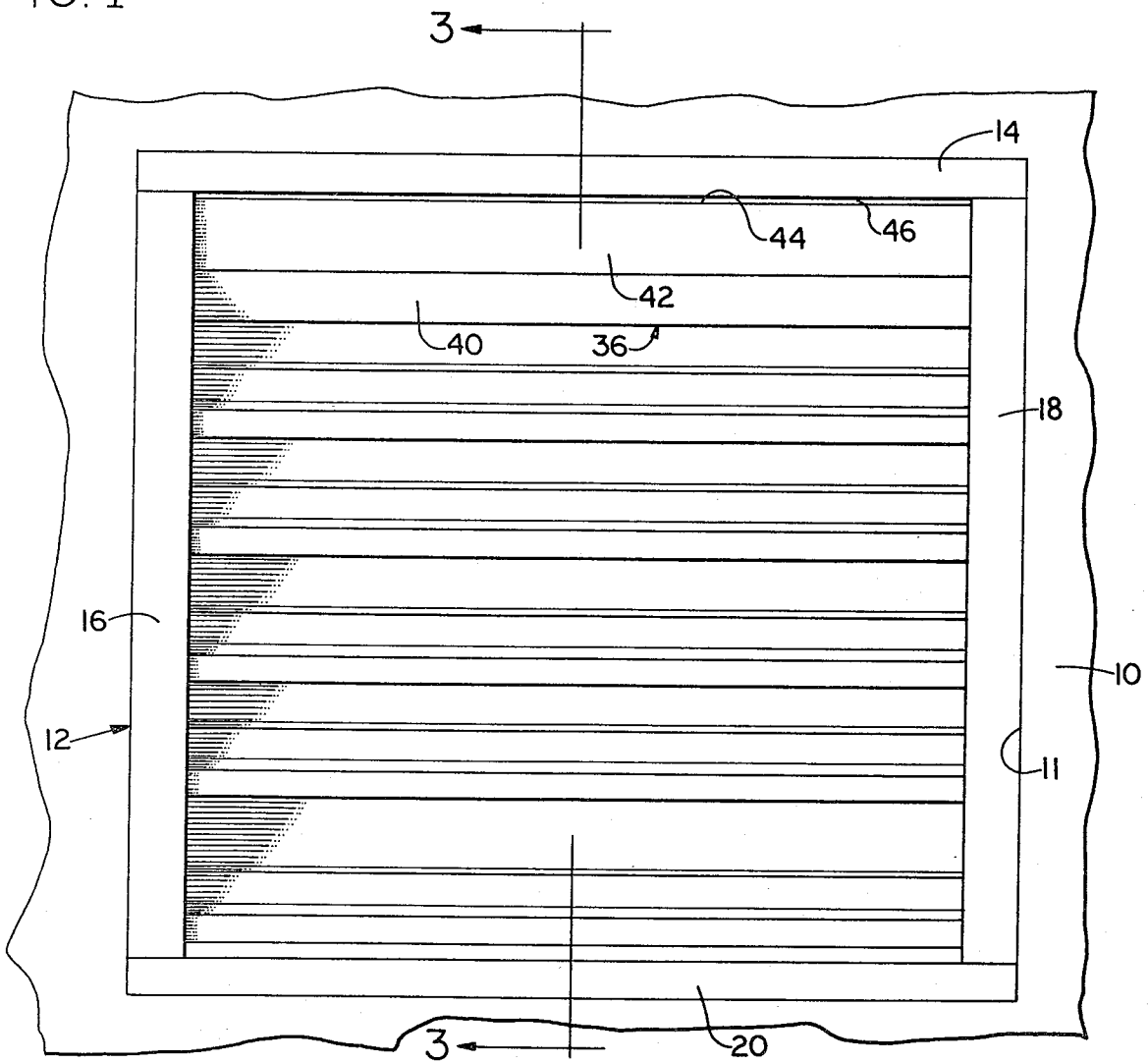
FIG. 1 is a view in side elevation showing a fragmentary portion of a wall of a building which includes a louver assembly constructed in accordance with an embodiment of this invention.
Figure 3:
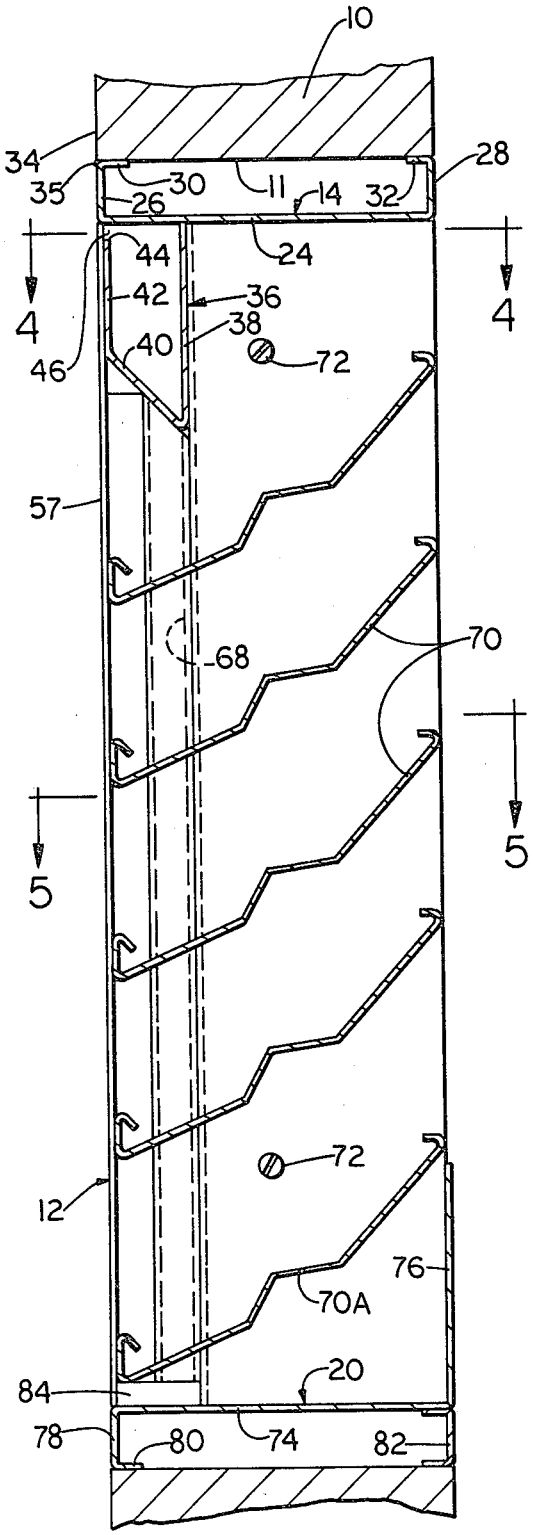
FIG. 3 is a view in section taken on an enlarged scale on the line 3—3 in FIG. 1.

In FIGS. 1 and 3 is shown a wall 10 of a building having a rectangular opening 11 therein in which is mounted a louver assembly 12 constructed in accordance with an embodiment of this invention. The louver assembly 12 includes a transverse upper header frame member 14, upright side frame members 16 and 18 and a bottom frame and plate member 20, which can be welded or otherwise attached together to form a rectangular framework that is received in the rectangular opening 11 in the wall 10. The header frame 14 includes a horizontal upper plate portion 24, upwardly extending outer and inner flanges 26 and 28 and horizontal return bend portions 30 and 32. The louver assembly 12 is mounted in the opening 11 with an outer face 34 of the wall 10 in alignment with an outer face of the outer flange 26. An appropriate bead of sealant 35 can form a seal between the outer flange 26 and the wall 10.

Figure 4:
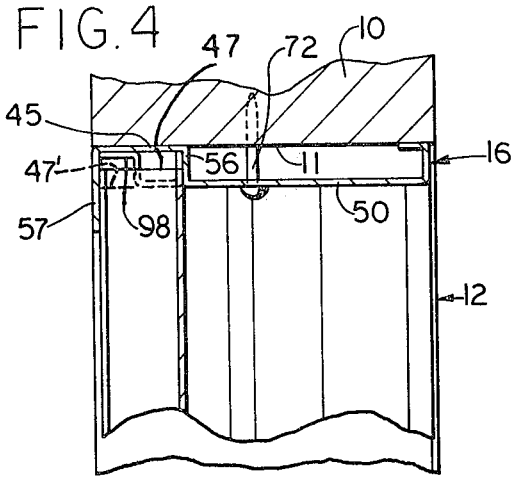
FIG. 4 is a fragmentary view in section taken on the line 4—4 in FIG. 3.
Figure 5:
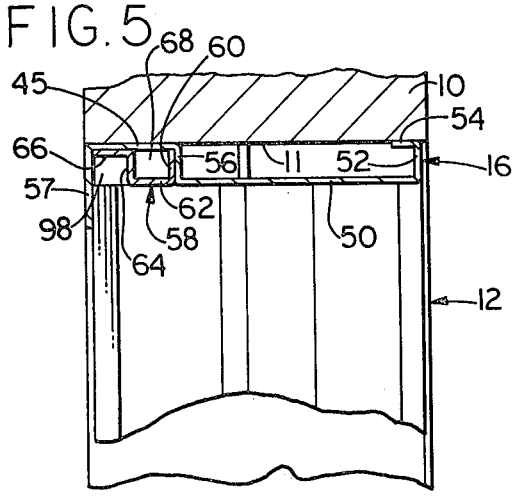
FIG. 5 is a view in section taken on the line 5—5 in FIG. 3.

A gutter member 36 is mounted immediately below the header frame 14. The gutter member 36 includes an upright support panel 38, a sloping panel 40 and an outer upright panel 42. An upper edge of the support panel 38 is attached to the underside of the upper plate portion 24 of the header frame 14 between inner and outer edges thereof. An upper edge 44 of the outer panel 42 terminates below the header frame 14 to form an elongated opening 46 through which rain water that runs down the outer face 34 of the wall 10 can enter the interior of the gutter member 36 to collect in the lower portion of the gutter member 36 and flow to ends of the gutter member. The gutter member 36 terminates short of downspout panels 45 of the side frames 16 and 18 at edges 47, one of which is shown in FIG. 4.

The side frames 16 and 18 and associated members are similar in construction and only the side frame 16 will be described in detail. The side frame 16 includes a main panel 50, an inner flange 52 and an inner return bend portion 54. A connecting panel 56 connects the downspout panel 45 to the main panel 50. A flange 57 is mounted on the outer edge of the downspout panel 45. A divider member 58 is mounted next to the downspout panel 45. The divider member 58 includes a flange 60, which engages flatwise against the connecting panel 56, channel defining panels 62 and 64 and a flange 66, which engages flatwise with a portion of the downspout panel 45. An edge of the flange 66 engages the flange 57 of the side frame 16. An upright conduit 68 is formed between the side frame 16 and the divider member 58. This conduit 68 receives water from an end of the lower portion of the gutter member 36, and the water from the gutter member 36 is enclosed in the conduit 68 and separated from blades 70 of the louver assembly 12 as the water from the gutter member 36 flows downwardly. Appropriate fasteners 72 extend through openings in the side frame 16 and are received in the wall 10 to hold the louver assembly in position in the wall opening 11.

The bottom frame and plate member 20 includes a horizontal plate portion 74, onto which the conduit 68 discharges water from the gutter member 36, an upright inner wall 76, a downwardly extending outer flange 78, and a return bend portion 80. A channel frame 82 is attached to the underside of the plate portion 74 at an inner edge thereof. Water from the plate portion 74 is discharged through an opening 84 at the outer edge of the plate portion 74 below blade member 70A.

Figure 7:
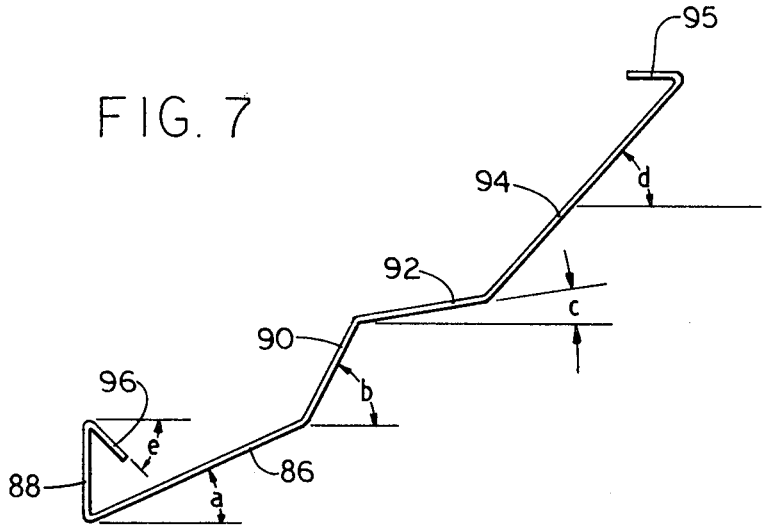
FIG. 7 is a view in end elevation of a louver blade removed from the louver assembly.

The louver blades 70 are similar. Details of construction of one of the louver blades 70 are shown in FIG. 7. The louver blade 70 includes an outer main panel 86, which slopes upwardly and inwardly from a vertical front panel 88 at an angle a of approximately 24 degrees to the horizontal. A first transition panel 90 extends upwardly and inwardly from the outer main panel 86 at an angle b of approximately 63 degrees to the horizontal. A second transition panel 92 extends upwardly and inwardly from the first transition panel 90 at an angle c of approximately 9 degrees to the horizontal. An inner main panel 94 extends upwardly and inwardly from the second transition panel 92 at an angle d of approximately 48 degrees to the horizontal. A horizontal flange 95 is mounted on the upper edge of the inner main panel 94. A downwardly and inwardly directed flange 96 is mounted on the upper edge of the front panel 88 and extends at an angle e of approximately 45 degrees to the horizontal.

Figure 6:
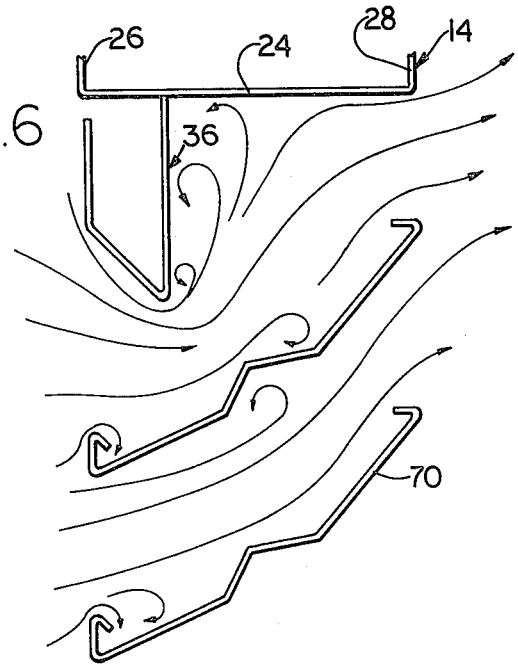
FIG. 6 is a schematic view showing flow of air through the louver assembly.

Rain water which collects on the face 34 of the wall 10 runs down the face 34 and enters the gutter member 36 through the elongated opening 46. This water collects in the lower portion of the gutter member 36 and flows to ends thereof to pass into the conduits 68. As shown in FIG. 1, the elongated opening 46 overlies substantially the entire length of the louver blades so that water which runs down the face of the upper frame member 14 is caught by the opening 46 and does not reach the louver blades 70. The conduits 68 discharge onto the plate portion 74. As shown in FIG. 6, air can enter between the blades 70. This air flows generally inwardly and upwardly, as indicated by arrows in FIG. 6, and the direction of air flow changes from a slightly ascending direction as the air enters to a more sharply ascending direction as the air approaches inner edges of the blades because of the differences in slope between the outer main panel 86 and the inner main panel 94. Water carried by the air is advanced into engagement with the blades to collect on the blades and flow down each blade to the lower edge thereof. The water on the blade flows along the blade to ends thereof to be discharged over the edges 47', one of which is shown in FIG. 4, to travel down an open-faced slot 98 which is defined by the flange 57, the flange 66, and the channel defining panel 64 to the plate portion 74. The water from the gutter member 36, as it flows down the conduits 68, does not fall on the blades 70, but is separated and isolated therefrom. From the plate portion 74, the water is discharged through the opening 84.

The louver structure described above and illustrated in the drawings is subject to structural modification without departing from the spirit and scope of the appended claims.

Having described my invention, what I claim as new and desire to secure by Letters Patent is:

1. A louver assembly which comprises a frame including a transverse upper member, upright side members, and a transverse lower member, a plurality of vertically spaced louver blades spanning the side members, a gutter member overlying the louver blades and underlying the upper member, the gutter member including an outer wall panel having an upper edge terminating beneath an outer face of the upper member to define a transverse water inlet opening receiving rain water from the transverse upper member, enclosed downspout means in one of the side members receiving water from the gutter member and conducting the water from the gutter member past the louver blades, and means in one of the side members for receiving water from the louver blades, the downspout means being isolated from the means for receiving water from the louver blades.

2. A louver assembly as in claim 1 in which the frame includes an outer side and an inner side, the louver blades extend upwardly and inwardly from outer edges thereof and the gutter member includes an inner wall spaced from the outer wall and spaced from the inner side of the frame and attached to the transverse upper member and extending downwardly therefrom, the gutter member overlying only a lower portion of an uppermost one of the louver blades.

3. A louver assembly as in claim 1 in which the transverse lower member includes a transverse plate portion and an inner wall portion extending upwardly therefrom, the downspout means and the means for receiving water from the louver blades discharging the water onto the transverse plate portion, there being an opening beneath a lowermost one of the louver blades for receiving the water from the transverse plate portion.

4. A louver assembly as in claim 1 in which each louver blade includes an outer main portion extending upwardly and inwardly from a lower edge at a small acute angle to the horizontal and an inner main portion extending upwardly and inwardly to an inner edge at a large acute angle to cause entering air to change direction while flowing inwardly between the louver blades.

5. A louver assembly as in claim 4 in which the small acute angle is approximately 24 degrees and the large acute angle is approximately 48 degrees.

6. A louver assembly as in claim 1 in which there is downspout means in both of the side members receiving water from the gutter member and in which there is means in both of the side members for receiving water from the louver blades.

* * * * *